United States Patent [19]

Sano et al.

[11] Patent Number: 4,840,927

[45] **Date of Patent: * Jun. 20, 1989**

[54] DESENSITIZER COMPOSITION

[75] Inventors: Shojiro Sano; Keiso Saeki, both of Shizuoka, Japan

[73] Assignee: Fuji Photo Film Co., Ltd., Kanagawa, Japan

[ * ] Notice: The portion of the term of this patent subsequent to Feb. 16, 2005 has been disclaimed.

[21] Appl. No.: 905,206

[22] Filed: Sep. 9, 1986

[30] Foreign Application Priority Data

Sep. 9, 1985 [JP] Japan ..... 60-198746

[51] Int. Cl.[4] ..... B41M 5/16

[52] U.S. Cl. ..... 503/201; 427/150; 427/151; 428/342; 428/914; 503/205; 503/206; 503/209; 503/221

[58] Field of Search ..... 106/21; 346/205, 206, 346/207; 427/150–152; 503/205, 206, 207, 201, 209, 221; 428/342, 913, 914

[56] References Cited

U.S. PATENT DOCUMENTS

| | | | |
|---|---|---|---|
| 2,777,780 | 1/1957 | Cormac et al. . | |
| 3,640,928 | 2/1972 | Murayama . | |
| 3,890,156 | 6/1975 | Matsukawa . | |
| 3,931,430 | 1/1970 | Tada et al. . | |
| 3,952,117 | 4/1976 | Miyamoto . | |
| 4,012,538 | 3/1977 | Miyamoto et al. . | |
| 4,022,624 | 5/1977 | Miyamoto et al. . | |
| 4,101,690 | 7/1978 | Miyamoto et al. . | |
| 4,337,280 | 6/1982 | Miyamoto et al. . | |
| 4,398,753 | 8/1983 | Asano et al. | 427/152 |
| 4,613,878 | 9/1986 | Inaba et al. | 346/205 |
| 4,620,205 | 10/1986 | Iiyama et al. | 346/205 |
| 4,725,315 | 2/1988 | Sano et al. . | |

FOREIGN PATENT DOCUMENTS

| | | |
|---|---|---|
| 1326889 | 8/1973 | United Kingdom . |
| 1354313 | 5/1974 | United Kingdom . |

OTHER PUBLICATIONS

*Heterocyclic Chemistry,* 2nd Ed., Joule and Smith, London, 1978, pp. 377 and 378.

*Primary Examiner*—Bruce H. Hess
*Attorney, Agent, or Firm*—Sughrue, Mion, Zinn, Macpeak & Seas

[57] ABSTRACT

A desensitizer composition consisting essentially of a 2,2,6,6-tetramethylpyperidine compound as a desensitizer and additives comprising a natural or synthetic high-molecular weight compound and a pigment, a color developer sheet containing the desensitizer composition and a process for forming an image using the color developer sheet. The composition exhibits superior desensitizing effects, especially when used with fluoran color formers.

11 Claims, No Drawings

DESENSITIZER COMPOSITION

FIELD OF THE INVENTION

The present invention relates to a desensitizer composition and, more particularly, to a desensitizer used in pressure-sensitive copying paper which reduces or eliminates the ability of a color developer to produce a color by reaction with a colorless color former.

BACKGROUND OF THE INVENTION

It has been known for many years that a color image can be produced by means of a reaction involving contact between an electron-donating or proton-accepting colorless organic compound (hereinafter referred to as a color former) and an electron-accepting or proton-releasing solid acid (hereinafter referred to as a color developer). This phenomenon is embodied in pressure-sensitive paper as described in U.S. Pats. Nos. 2,505,470, 2,505,489, 2,550,471, 2,548,366, 2,712,507, 2,730,456, 2,730,457, 3,418,250 and 3,672,935. A printing method has been proposed that involves preparing a sheet coated with color developer and producing a color image on that sheet by supplying an ink containing a color former; this technique is disclosed in German Patent Application (OLS) No. 1,939,962.

The color developer has the properties defined above and is selected from among clays, phenolic resins, and metal salts of aromatic carboxylic acids. Since these color developers are usually coated in a uniform thickness on the entire surface of a support, the non-image areas of the color developer sheet are desensitized by printing or otherwise coating a composition containing an appropriate desensitizer.

Desensitizer are described in U.S. Pats. Nos. 2,777,780, 3,890,156, 3,931,430, 3,952,117, 4,012,538, 4,022,624 and 4,101,690; West German Pat No. 2,526,592; West German Patent Application (OLS) Nos. 2,359,079 and 2,727,194; Belgian Pat. No. 804,221; Japanese Patent Publication Nos. 29546/71, 23850/74, 14571/75 and 29365/75; and Japanese Patent Application (OPI) Nos. 125018/77 and 67291/81 (the term "OPI" as used herein means a "published unexamined Japanese Patent Application"). Specific examples of the desensitizer include dodecyl trimethylammonium chloride, dodecylamine, 2,4,4-trimethyl-2-oxazoline, xylenediamine, polyoxyethylene alkylamine, polyoxyethylene alkylether, polyoxyethylene alkylphenyl ether, polyethylene glycol, polypropylene glycol, glycidyl ether adducts of amines, etc.

These desensitizers, however, are not completely satisfactory in their desensitizing effects and their effectiveness is particularly low with respect to such fluoran color formers as 3,6-bis-diphenylaminofluoran and 3-diethylamino-7-dibenzylaminofluoran. If a color former is brought into contact with a color developer sheet after a desensitizer is coated in the non-image areas, the non-image areas initially seem to be completely desensitized. However, if the sheet is exposed to light (particularly sunlight) a color image often appears on the non-image areas. In order to avoid this problem, a very thick coat of the desensitizer must be formed on the sheet of color developer by printing, but then the printed surface will dry so slowly that the printing speed cannot be increased to an industrially acceptable level.

In addition, if characters are written or printed with a color ink on the surface of the sheet of color developer that has been coated with an increased amount of desensitizer, the resulting ink image wil undergo extensive discoloration or may be blurred.

SUMMARY OF THE INVENTION

A primary object, therefore, of the present invention is to provide a desensitizer composition which exhibits excellent desensitizing effects with respect to color frames, especially fluoran color formers.

This object of the present invention is attained by a desensitizing composition consisting essentially of a 2,2,6,6-tetramethylpiperidine compound as a desensitizer and additives.

DETAILED DESCRIPTION OF THE INVENTION

Specific examples of the 2,2,6,6-tetramethylpiperidine compound used in accordance with the present invention are shown below, although the present invention is not to be construed as being limited thereto.

Compound I

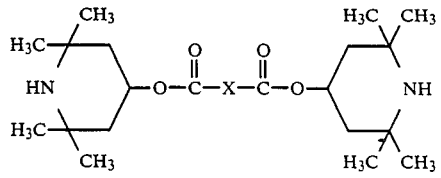

wherein X is an alkylene group having from 1 to 18 carbon atoms.

Compound II

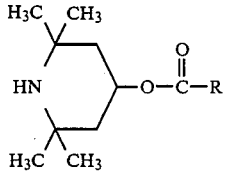

wherein R is an alkyl group having from 1 to 18 carbon atoms, an aryl group having from 6 to 12 carbon atoms or an aralkyl group having from 7 to 12 carbon atoms.

Compound III

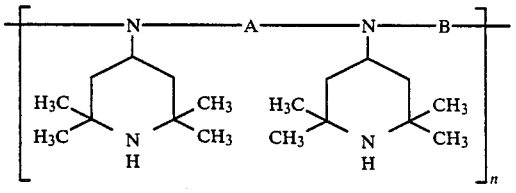

wherein A and B, which may be the same or different, are an alkylene group having from 1 to 12 carbon atoms, an alkenylene group having from 2 to 12 carbon atoms or an alkynylene group having from 2 to 12 carbon atoms; and n is an integer of 1 to 12.

Compound IV

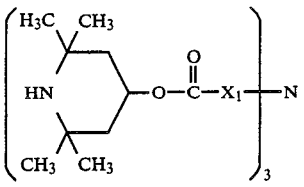

wherein $X_1$ is an alkylene group having from 1 to 12 carbon atoms.

Compound V

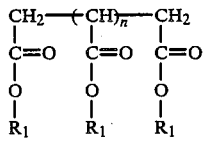

wherein $R_1$ is

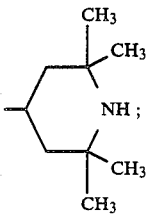

and n is an integer of 1 to 12.

Compound VI

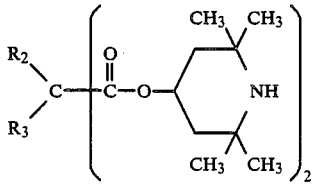

wherein $R_2$ and $R_3$, which may be the same or different, each represents an alkyl group having from 1 to 18 carbon atoms, an aryl group having from 6 to 12 carbon atoms or an aralkyl group having from 7 to 12 carbon atoms.

Compound VII

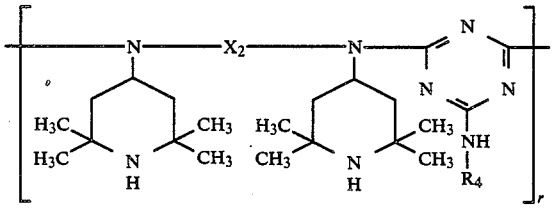

wherein $X_2$ represents an alkylene group having from 1 to 12 carbon atoms; $R_4$ represents an alkyl group having from 1 to 12 carbon atoms; and r represents an integer of 1 to 12.

In the following discussion, all percentages, ratios, etc., are by weight unless indicated otherwise.

The compounds listed above and other 2,2,6,6-tetramethylpiperidine compounds are incorporated in the densensitizing composition of the present invention in amounts preferably ranging from about 10 to about 80% by weight, more preferably from 15 to 60% by weight, based on the total weight of the desensitizing composition.

Additives incorporated in the desensitizer composition of the present invention are natural or synthetic high-molecular weight compounds such as ketone resins, polyamide resins, maleic acid resins, phenolic resins, epoxy resins, alkyd resins, melamine resins, urea resins, polyvinyl alcohol, gelatin, and shellac (phenolic resins such as rosin-modified phenolic resins, maleic resins such as rosin-modified maleic resins and ketone resins are desirable, and these compounds are typically incorporated as binder in the desensitizer composition in an amount of not more than about 40 wt %, and preferably from 5 to 25 wt %), and pigments such as titanium dioxide, barium sulfate, calcium carbonate, talc, kaolin, bentonite, and organic bentonite (basic pigments such as titanium dioxide and calcium carbonate are desirable, and the aforementioned pigments are typically incorporated in the desensitizer composition in an amount of not more than about 50 wt %, and preferably from 0.3 to 40 wt %).

Other various additives may be incorporated in the desensitizer composition of the present invention and they may be selected from among the ingredients of common printing inks which are described, e.g., in detail in Chapters 2 to 9 of E.A. Apps, *Printing Ink Technology,* Leonard Hill, London, 1961; illustrative additives are vegetable oils such as linseed oil, tung oil, soybean oil, and cottonseed oil, or heated polymers thereof (these oils or heated polymers thereof are typically incorporated in an amount of from 0 to about 50%, and preferably from 0 to 20%, i.e., based on the total weight of the desensitizer composition); wax such as paraffin wax, microcrystalline wax, and carnauba wax (these are typically incorporated in an amount of from 0 to about 10 wt %, and preferably from 0 to 5 wt %); and set-off preventing agents such as starch and dextrin (which are typically incorporated in an amount of from 0 to about 10 wt %, and preferably from 0 to 5 wt %).

All weight percentages in the above paragraph are based on the total weight of the desensitizer composition.

The desensitizer composition of the present invention may be readily prepared by those skilled in the art by mixing the ingredients described above, melting the mixture, and optionally kneading the melt with a three-roll mill, a kneader, etc. The resulting desensitizer composition is coated onto the sheet of color developer by printing with, for example, a letter-press, dry offset, or wet offset printing machine. In the desensitizer composition of the present invention, if necessary, a solvent such as an ethanol, an isopropyl alcohol, etc. may be used. The coating weight of the desensitizer composition typically ranges from about 0.8 to about 10.0 g/m$^2$, preferably from 1.5 to 6.0 g/m$^2$.

Examples of the color developer with which the desensitizer composition of the present invention may be employed include clays (e.g., acid clay, activated clay, attapulgite, and kaolin), phenolic resins, and metal salts of aromatic carboxylic acid. The phenolic resins may be illustrated by phenol-aldehyde polymers (generally referred to as "novolak type" resins) and phenolacetylene polymers. Illustrative examples of the metal salts of aromatic carboxylic acids are shown in U.S.

Pats. Nos. 3,864,146 and 3,983,292, and Japanese Patent Application (OPI) No. 120010/79.

A useful example of the aromatic carboxylic acid in the metal salt has a hydroxyl group in the position ortho or para to the carboxyl group. A salicylic acid derivative is preferable, and a particularly preferable derivative is such that it has a substituent (e.g., alkyl, aryl, or aralkyl) in at least one of the positions which are ortho and para to the hydroxyl group, with the total of the carbon atoms in the substituents being at least 8. These aromatic carboxylic acids from metal salts with metals which are preferably selected from among zinc, tin, and aluminum, with zinc providing best results.

The color developers illustrated above are coated onto a support such as paper together with a binder such as a styrene-butadiene latex.

The coating weight of the color developer is preferably from 0.2 to 1.0 g/m$^2$.

The desensitizer composition of the present invention will prove most effective when used with fluoran color formers which have presented considerably difficulty in desensitization but, needless to say, this composition may exhibit the intended function even if it is used with other types of color frames.

Specific examples of the color formers that may advantageously be used with the desensitizer composition of the present invention are listed below:

(1) fluoran compounds such as 3,6-bisdiphenylamino-fluoran, 3-diphenylamino-6-ditolylamino-fluoran, 3,6-bis(N-phenyl-N-tolyl)aminofluoran, 3,6-bis (N-phenyl-N-anicyl)aminofluoran, 3,6-bis(N-p-chlorophenyl-N-phenyl)aminofluran, 3-diphenylamino-6-(N-phenyl-N-iso-propylphenyl)aminofluoran, 3-diethylamino-7-dibenzylamino-fluoran, 3-diethylamino-7,8-benzofluoran, 3-diethylamino-6-methyl-7-anilinofluoran, 3-diethylamino-6-chloro-7-anilinofluoran, 3-dimethylamino-7-methoxyfluoran, 3-diethyl-amino-6-methoxyfluoran, 3-N-isopentyl-N-ethylamino-6-methyl-7-anilinofluoran, 3-N-cyclohexyl-N-methylamino-6-methyl-7-anilinofluoran, and 3-N-ethyl-N-tolylamino-6-methyl-7-anilinofluoran;

(2) triarylmethane compounds such as 3,3-bis(p-dimethylaminophenyl)-6-dimethylaminophthalide, 3-bis-(1,2-dimethylindole-3-yl)-5-dimethylaminophthalide;

(3) diphenylmethane compounds such as bis (4-dimethylaminophenyl)-(p-toluenesulfonyl)methane and bis (4-dimethylaminophenyl)-benzenesulfonylmethane;

(4) thiazine compounds such as benzoylleucomethylene blue and p-nitrobenzoyl-leucomethylne blue; and (5) spiro compounds such as 3-methyl-spiro-dinaphthopyran and 3-propyl-spiro-dibenzopyran.

These color formers are coated onto a support after they are dissolved in solvents for capsule formation or dispersed in binder solutions. The coating weight of the color former is preferably from 0.04 to 0.2 g/m$^2$.

Natural or synthetic oils may be used as solvents of the color formers either independently or in combination. More specific examples of the solvents include cottonseed oil, kerosene, paraffin, naphthenic oil, alkylated biphenyl, alkylated terphenyl, chlorinated paraffin, alkylated naphthalene and diarylethane.

Microcapsules of color former may be prepared by using the coacervation of hydrophilic colloid sols as described in U.S. Pats. Nos. 2,800,457 and 2,800,458, the interfacial polymerization method described in British Pats. Nos. 867,797, 950,443, 989,264, and 1,091,076, the internal polymerization method the phase-separation method and the external polymerization method.

The present invention is be illustrated in greater detail with reference to the following examples, but it is to be understood that these examples do not limit the present invention. In these examples, all the percents, parts and ratios are by weight unless otherwise indicated.

EXAMPLE

The effectiveness of the desensitizer composition of the present invention was confirmed with a sheet of color developer and two sheets of color former that were prepared by the following procedures.

Preparation of Color Developer Sheet:

Zinc oxide (2 parts), calcium carbonate (18 parts), acid-treated active clay (2 parts), and zinc 3,5-di-$\alpha$-methylbenzylsalicylate (4 parts) were mixed in 70 parts of water. After dispersing the ingredients by treatment with an attritor for 30 minutes, a carboxylmodified SBR latex (2.5 parts in terms of solids content) and 12 parts of a 10 wt % aqueous solution of PVA (degree of saponification: 99% and degree of polymerization: 1,000) were added to the dispersion and the mixture was uniformly agitated to form a coating solution. This solution was coated onto a raw paper (50 g/m$^2$) with an air knife coater to provide a coat having a solids content of 4 g/m$^2$ and dried to obtain a color developer sheet.

Preparation of Color Former Sheet A:

Ten parts of an acid-treated gelatin having an isoelectric point of 8.0 and 10 parts of gum arabic were dissolved in 60 parts of water at 40° C. To the solution, 0.2 part of sodium alkylbenzenesulfonate was added as an emulsifier and an emulsion was formed by addition of 50 parts of a color former oil. This color former oil was an oil that was composed of 1-phenyl-1-xylythane (4 parts) and kerosene (1 part) and which had 3,6-bis-diphenylaminofluoran (4.0 wt %) dissolved therein.

When the emulsion globules grew to an average size of 6 microns, 100 parts of water (40° C.) was added to quench the progress of emulsification.

With continued agitation, an additional 210 parts of water (30° C.) was added and then the pH of the system was adjusted to 4.4 by addition of 20% HCl. With continued agitation, the solution was cooled to 8° C., followed by the addition of 1.5 parts of 20% glutaraldehyde.

Subsequently, 30 parts of a 10% solution of carboxymethylated starch was poured in and the pH of the system was adjusted by dropwise addition of 25% sodium hydroxide. Thereafter, the solution was heated to 30° C., thereby producing microcapsules having hardened walls.

Ten parts of cellulose flocs were dispersed in the solution, which was then applied to paper (40 g/m$^2$) to provide a coat having a solids content of 6 g/m$^2$ and dried to obtain a color former sheet A.

Preparation of Color Former Sheet B:

A color former oil was prepared by dissolving 6 wt % of 3-diethylamino-7-dibenzylaminofluoran and 3 wt % of 3-diethylamino-7,8-benzofluoran in 4 parts of diisopropyl-naphthalene. Fifty parts of this oil was processed as in the preparation of Color Frame Sheet A, thereby producing a Color Former Sheet B.

Preparation of Color Former Sheet C:

A color former oil was prepared by dissolving 3 wt % of 3-N-isopenthyl-N-ethylamino-6-methyl-7-anilinofluoran, 2 wt % of 3,6-bis-diphenylaminofluoran and 2,5 wt % of 3-N-cyclohexylamino-6-chlorofluoran in 4 parts of diisopropylnaphthalene. Fifty parts of this oil was processed as in the preparation of Color Former Sheet A, thereby producing a Color Former Sheet C.

Preparation of Desensitizing Inks:

A mixture of fifteen parts of a rosin-modified maleic acid resin (softening point 120° C. and acid value 150), 15 parts of titanium dioxide, 30 parts of a selected desensitizer (listed in Table) and 30 parts of ethanol was kneaded with a ball mill, thereby forming a desensitizing ink base.

Test Method

Each of the desensitizing ink composition was print-coated onto the color developer sheet to form a coat having a solids content of 2.0 g/m$^2$. The desensitized surface of each sample was superposed on color former sheet A, B or C and a load of 600 kg/cm$^2$ was applied to the assembly so as to effect color formation and development. After exposure to the sunlight for 2 hours, the reflection visual density (Vis. D) of the image formed on each of the samples was measured with a densitometer (Macbeth Model RD 514) so as to evaluate the desensitizing effect of each ink composition. The results are shown in Table.

TABLE

| Run No. | Desensitizer | Desensitizing Effect (Vis. D) Color Former A | Color Former B | Color Former C |
|---|---|---|---|---|
| Example 1 | Dp-1 | 0.06 | 0.09 | 0.08 |
| Example 2 | Dp-2 | 0.07 | 0.09 | 0.09 |
| Example 3 | Dp-3 | 0.07 | 0.09 | 0.08 |
| Example 4 | Dp-4 | 0.07 | 0.09 | 0.08 |
| Example 5 | Dp-5 | 0.06 | 0.09 | 0.09 |
| Example 6 | Dp-6 | 0.07 | 0.10 | 0.09 |
| Example 7 | Dp-7 | 0.07 | 0.09 | 0.08 |
| Comparative Example 1 | Dc-1 | 0.16 | 0.21 | 0.17 |
| Comparative Example 2 | Dc-2 | 0.12 | 0.16 | 0.14 |
| Comparative Example 3 | Dc-3 | 0.17 | 0.22 | 0.20 |

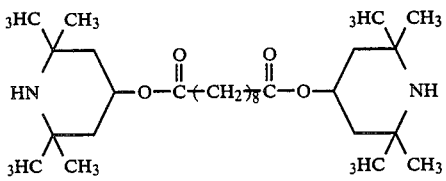
Dp-1

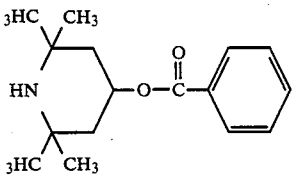
Dp-2

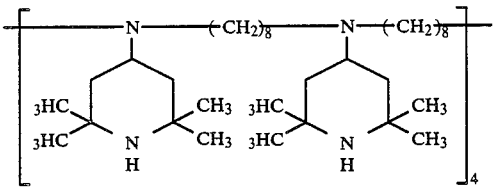
Dp-3

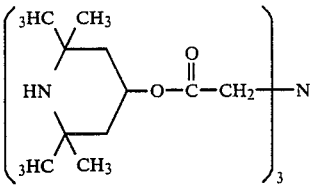
Dp-4

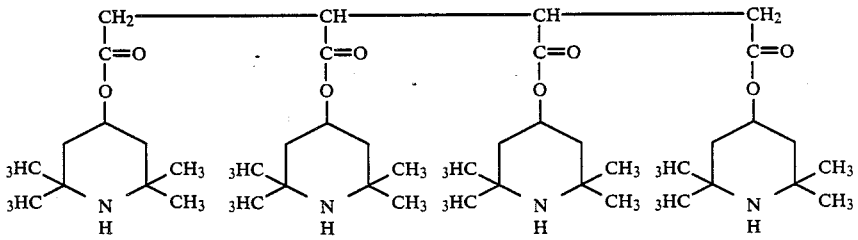
Dp-5

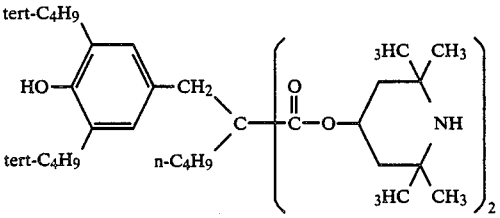
Dp-6

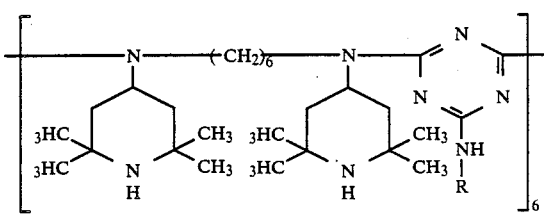
Dp-7

(R = tert-octyl group)

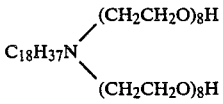
Dc-1

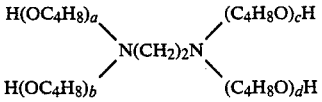
Dc-2 a + b + c + d = 12

Polypropylene glycol (Average molecular weight = 400) Dc-3

The advantageous of the desensitizing compositions prepared in accordance with the present invention are obvious from Table, wherein the lower figures represent higher degrees of desensitizing effect.

When the desensitizing composition using hitherto known desensitizer was used, a color image emerged from the desensitized surface as a result of exposure to sunlight for 2 hours. However, the use of the desensitizing composition comprising a 2,2,6,6-tetramethylpiperidine compound as a desensitizer enabled a substantially complete desensitization of the color developer sheet.

While the invention has been described in detail and with reference to specific embodiments thereof, it will be apparent to one skilled in the art that various changes and modifications can be made therein without departing from the spirit and scope thereof.

What is claimed is:

1. A color developer sheet for development of substantially colorless organic color formers comprising a substrate having provided thereon an electron-accepting color developer compound containing layer, said color developer compound containing layer having provided thereon a desensitizer composition consisting essentially of a 2,2,6,6-tetramethylpiperidine compound as a desensitizer and additives comprising a natural or synthetic high-molecular weight compound and a pigment.

2. A color developer sheet composition as claimed in claim 1, wherein the 2,2,6,6-tetramethylpiperidine is selected from the group consisting of the following compounds:

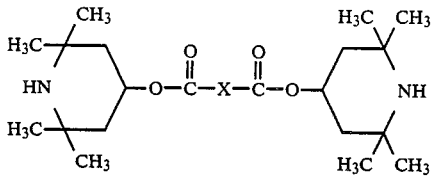

(I)

wherein X is an alkylene group having from 1 to 18 carbon atoms;

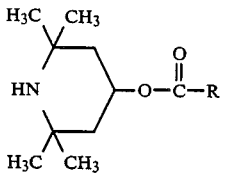

(II)

wherein R is an alkyl group having from 1 to 18 carbon atoms, an aryl group having from 6 to 12 carbon atoms or an aralkyl group having from 7 to 12 carbon atoms;

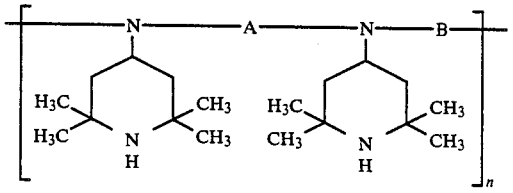

(III)

wherein A and B, which may be the same or different, are an alkylene group having from 1 to 12 carbon atoms, an alkenylene group having from 2 to 12 carbon atoms or an alkynylene group having from 2 to 12 carbon atoms; and n is an integer of 1 to 12;

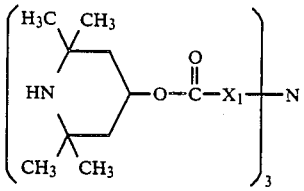

(IV)

wherein $X_1$ is an alkylene group having from 1 to 12 carbon atoms;

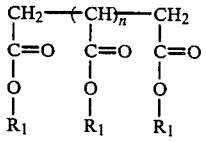

(V)

wherein $R_1$ is

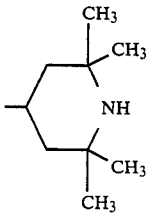

and n is an integer of 1 to 12;

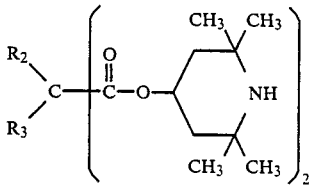

(VI)

wherein $R_2$ and $R_3$, which may be the same or different, each represents an alkyl group having from 1 to 18 carbon atoms, an aryl group having from 6 to 12 carbon atoms or an aralkyl group having from 7 to 12 carbon atoms; and

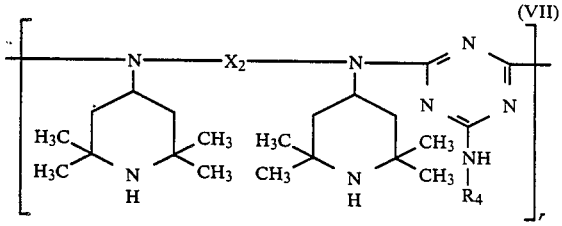

(VII)

wherein $X_2$ represents an alkylene group having from 1 to 12 carbon atoms; $R_4$ represents an alkyl group having from 1 to 12 carbon atoms; and r represents an integer of 1 to 12.

3. A color developer sheet composition as claimed in claim 2 wherein the 2,2,6,6-tetramethylpiperidine compound is incorporated in the desensitizing composition in an amount of about 10 to about 80% by weight based on the total weight of the desensitizing composition.

4. A Color developer Sheet composition as claimed in claim 3, wherein the 2,2,6,6-tetramethylpiperidine compound is incorporated in the desensitizing composition in an amount of from 15 to 60% by weight based on the total weight of the desensitizing composition.

5. A color developer sheet as claimed in claim 2 wherein the coating weight of the desensitizer composition is from about 0.8 to about 10.0 g/m$^2$.

6. A color developer sheet as claimed in claim 5, wherein the coating weight of the desensitizer composition is from 1.5 to 6.0 g/m$^2$.

7. A color developer sheet as claimed in claim 1, wherein the color developer is selected from the group consisting of clays, phenolic resins and metal salts of aromatic carboxylic acid.

8. A color developer sheet as claimed in claim 1, wherein said desensitizer composition consists of a single 2,2,6,6-tetramethylpiperidine compound.

9. A process for forming an image comprising either (i) superposing a color former sheet containing a color former on a color developer sheet and applying pressure to the sheets so as to imagewise effect color formation and development or (ii) imagewise applying ink containing the color former to the color developer sheet so as to effect color formation and development, wherein the color developer sheet comprises a color developer and the desensitizing composition of claim 2.

10. A process for forming an image as claimed in claim 9 wherein the color developer is selected from the group consisting of clays, phenolic resins and metal salts of aromatic carboxylic acids and the color former is selected from the group consisting of fluoran compounds, triarymethane compounds, diphenylmethane compounds, thiazine compounds and spiro compounds.

11. A process for forming an image as claimed in claim 10 wherein the color former is a fluoran compound.

* * * * *